US010989415B2

(12) United States Patent
Hackley

(10) Patent No.: US 10,989,415 B2
(45) Date of Patent: Apr. 27, 2021

(54) ENTERTAINMENT APPARATUS

(71) Applicant: BBQ Guy's Manufacturing, LLC, Baton Rouge, LA (US)

(72) Inventor: Michael Hackley, Baton Rouge, LA (US)

(73) Assignee: BBQGUYS MANUFACTURING, LLC, Baton Rouge, LA (US)

( * ) Notice: Subject to any disclaimer, the term of this patent is extended or adjusted under 35 U.S.C. 154(b) by 158 days.

(21) Appl. No.: 16/296,945

(22) Filed: Mar. 8, 2019

(65) Prior Publication Data

US 2019/0277506 A1 Sep. 12, 2019

Related U.S. Application Data

(60) Provisional application No. 62/640,812, filed on Mar. 9, 2018.

(51) Int. Cl.

| | |
|---|---|
| ***F24B 1/191*** | (2006.01) |
| ***A47F 9/00*** | (2006.01) |
| ***F21V 33/00*** | (2006.01) |
| ***F24B 1/181*** | (2006.01) |

(52) U.S. Cl.

CPC ..... *F24B 1/191* (2013.01); *A47F 9/00* (2013.01); *F21V 33/0012* (2013.01); *F24B 1/181* (2013.01)

(58) Field of Classification Search

CPC ..... F21V 33/0012; F24B 1/191; F24B 1/181; F24B 37/04; F24B 2220/0091; F24B 2220/0077; A47F 9/00; A47F 11/06

See application file for complete search history.

(56) References Cited

U.S. PATENT DOCUMENTS

| | | | | |
|---|---|---|---|---|
| 5,092,312 | A * | 3/1992 | Zolow | F24B 1/191 126/500 |
| 6,901,925 | B2 * | 6/2005 | Coughlin | F24B 1/198 126/500 |
| 7,537,015 | B1 * | 5/2009 | Molnar, IV | A45B 23/00 108/50.12 |
| 8,469,702 | B2 * | 6/2013 | Muff | F23N 5/242 431/350 |
| D748,768 | S * | 2/2016 | Stanton | D23/343 |
| 2003/0041855 | A1 * | 3/2003 | Grady | F24B 1/181 126/519 |
| 2016/0123335 | A1 * | 5/2016 | Molnar, IV | F24F 7/007 108/28 |
| 2017/0108227 | A1 * | 4/2017 | Doorandish | G06F 3/165 |

* cited by examiner

*Primary Examiner* — Alfred Basichas

(74) *Attorney, Agent, or Firm* — Robert Devin Ricci; Kean Miller LLP

(57) ABSTRACT

An entertainment device is disclosed herein which integrates a fire feature, a water feature, a music system, and a controlled lighting feature into a single piece of furniture.

18 Claims, 7 Drawing Sheets

ENTERTAINMENT APPARATUS

CROSS REFERENCE TO RELATED APPLICATION

This application claims priority to U.S. Provisional Patent Application No. 62/640,812, filed on Mar. 9, 2018, entitled "Entertainment Apparatus."

STATEMENT REGARDING FEDERALLY SPONSORED RESEARCH OR DEVELOPMENT

Not applicable.

REFERENCE TO A "SEQUENCE LISTING", A TABLE, OR COMPUTER PROGRAM

Not applicable.

DESCRIPTION OF THE DRAWINGS

It should be understood that the drawings are not necessarily to scale; instead, emphasis has been placed upon illustrating the principles of the invention. In addition, in the embodiments depicted herein, like reference numerals in the various drawings refer to identical or near identical structural elements. Some components have been removed from the figures to allow other components to be viewed.

FIELD OF THE INVENTION

Figure 1:
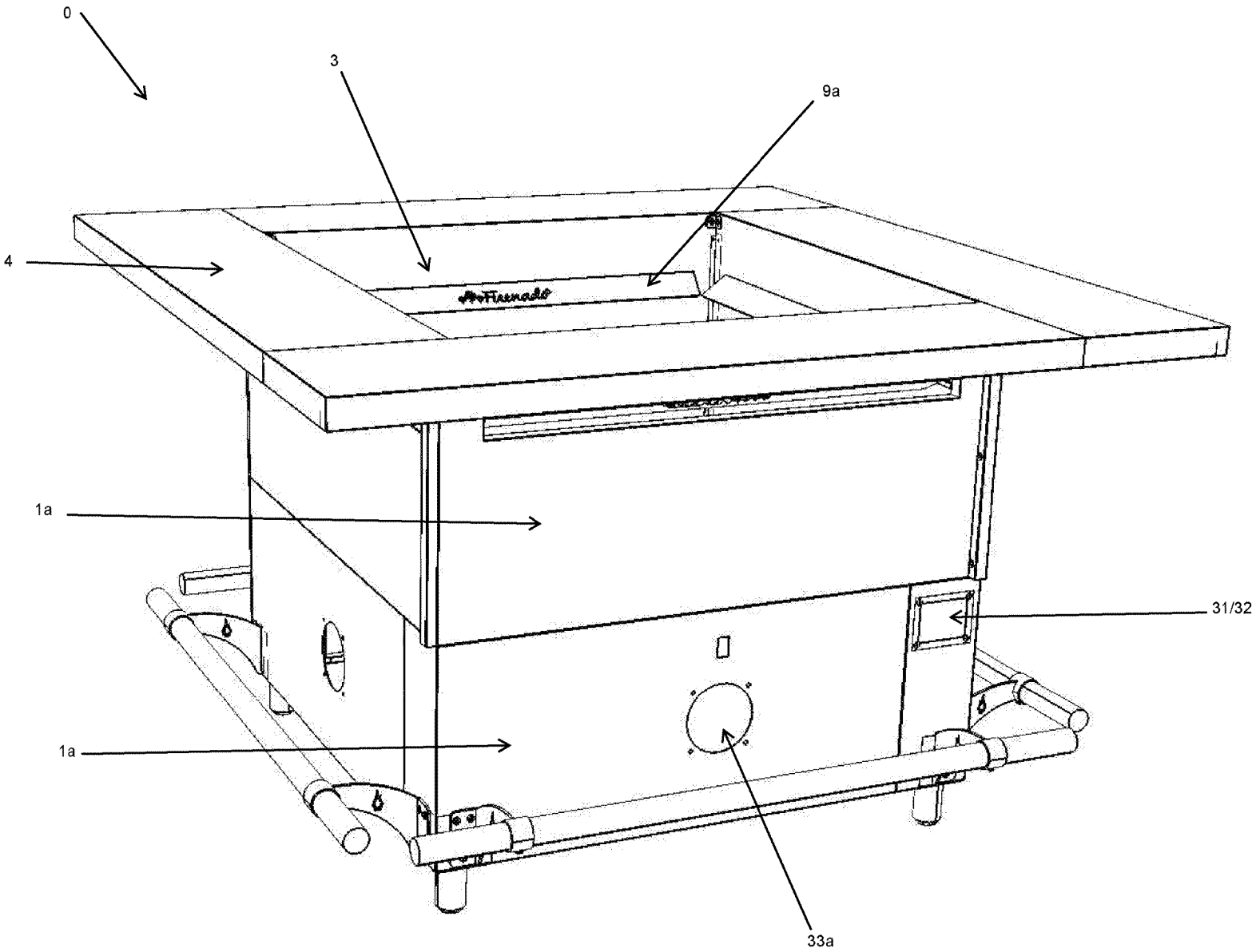
FIG. 1 is an angled view of an embodiment of the entertainment table with an extension piece to make the table bar height.
Figure 2:
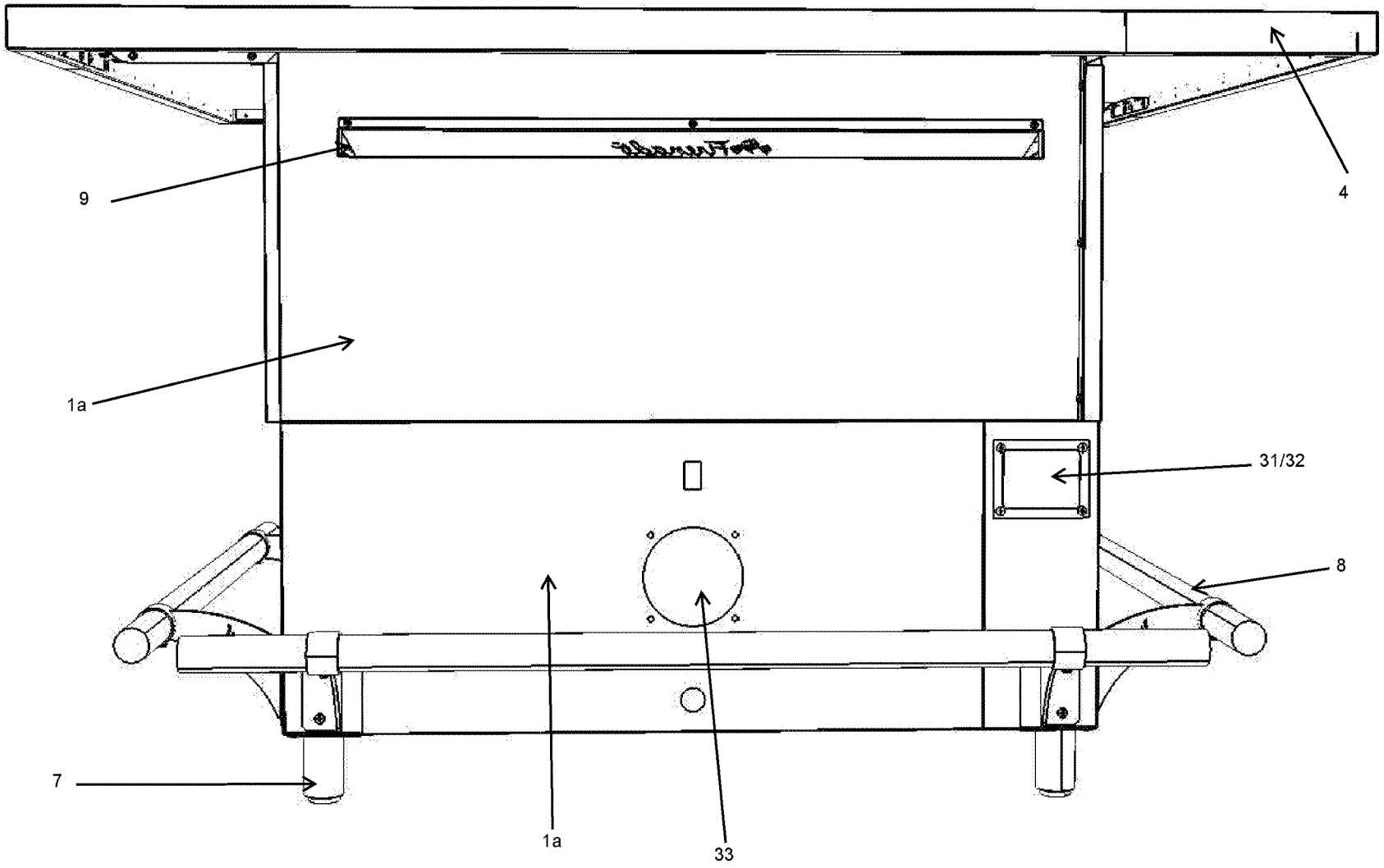
FIG. 2 is a side view of the same embodiment of the entertainment table from FIG. 1.
Figure 3:
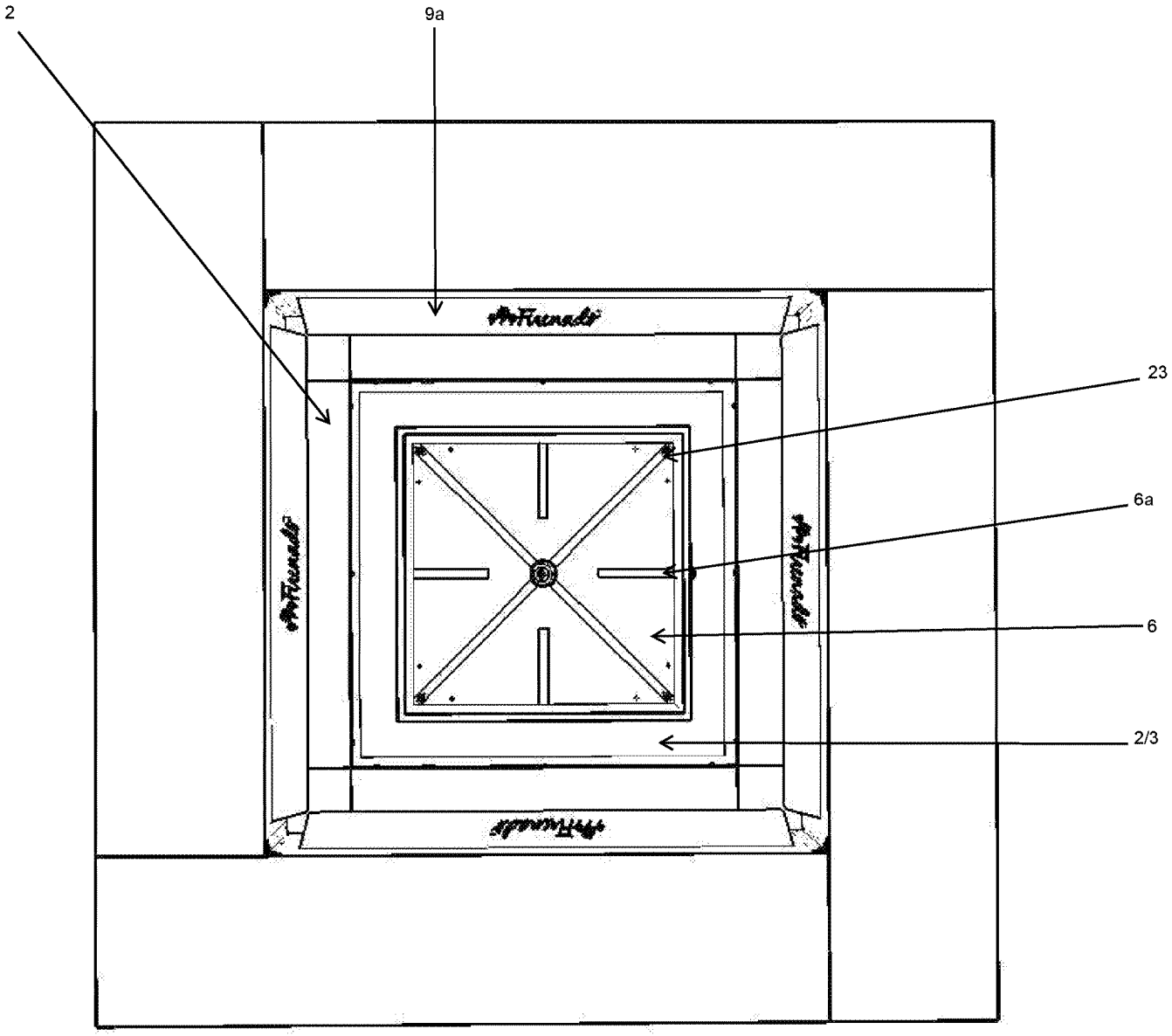
FIG. 3 is a top down view of the same entertainment table with the fire tray removed.
Figure 4:
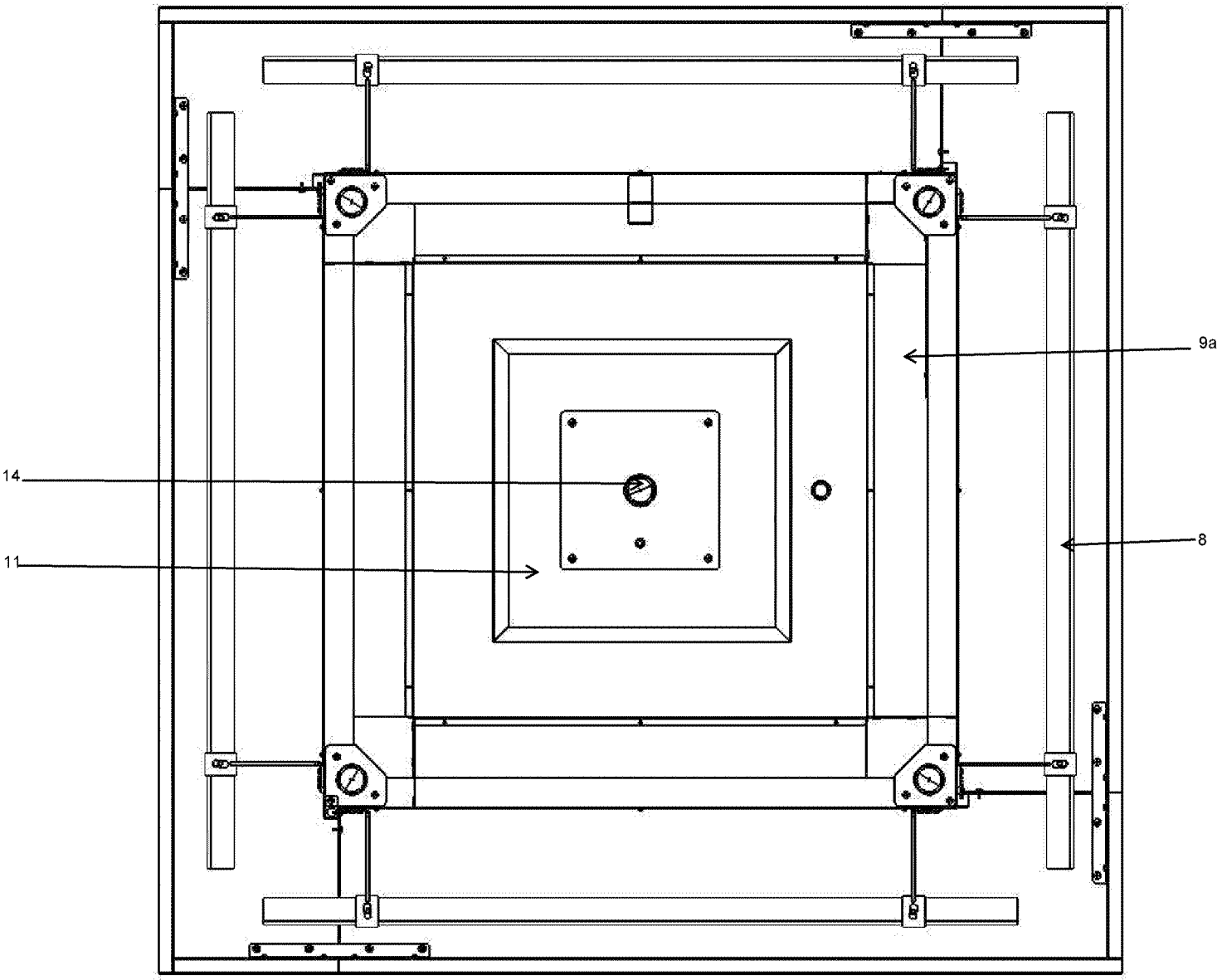
FIG. 4 is the same as FIG. 3 with the fire tray added, but the burner removed.

This invention relates to an entertainment piece. Namely, this invention relates to a piece of furniture that combines a fire feature, a water feature, a light feature, and/or a music feature.

BACKGROUND OF THE INVENTION

The outdoor recreation industry has experienced monumental growths in recent years. Consumers are expanding their desires for outdoor features and gadgets to turn back yard and outdoor commercial spaces into paradise escapes.

Fire features, such as fire pits are a mainstay in many backyards across the globe for both conventional warmth and for entertainment purposes. Fire pits, particularly fire pit tables, are a centerpiece around which friends and family can gather and enjoy each other's company.

Fountains and water features are another common attraction in outdoor settings that cause others to gather. The sounds of the water feature fill the ambient atmosphere, creating a calming ambience and white noise.

No outdoor gathering is complete without music and lighting. A sound system is a staple to any gathering, and even more so in an outdoor setting where common entertainment such as televisions may not be possible. True, the fire feature will give off some light; however, it does not light the area outside the purview of the flames, nor does it provide the flexibility to alter the lighting to change the ambience. Therefore, most outdoor spaces employ lighting features to allow users to continue the enjoyment into the nighttime hours.

Outdoor space, however, is a luxury commodity afforded only to a few in great quantity. Thus, there exists a need to integrate recreational components to the extent possible. To that end, an entertainment table is provided herein that marries otherwise incompatible components to provide a one-stop entertainment piece that can fit the growing needs of industry consumers.

SUMMARY

In one or more embodiments, the entertainment piece comprises a piece of furniture with one or more of the following features: a fire feature, a water feature, a lighting feature, and/or a music feature. In a preferred embodiment, the entertainment piece is a table comprising all of the above features.

The furniture may be the height of a conventional fire pit. In other embodiments, the furniture may be bar height. In some embodiments, the height of the furniture is dictated by leg members. In a preferred embodiment, the legs place the top of the furniture at conversation height. In another embodiment, the legs are elongated to lift the top of the furniture to bar height. In a preferred embodiment, the furniture further comprises a flat surface upon which things can be placed. The flat surface may be a ledge on the top end of the side walls that surrounds an opening or basin in the furniture. In other embodiments, it may comprise at least two wheels to assist in moving the apparatus. When bar height is desired, an extender may be used to elongate the sidewalls or the sidewalls may be taller to make the ledge bar height without raising the center of gravity.

In a preferred embodiment, the entertainment table comprises a fire feature.

The fire feature comprises a flame element such as a burner or other apparatus designed to provide a flame when connected to a fuel source. The fuel source may be propane, natural gas, or another combustible fuel. When the fuel source is a combustible fuel, the fuel source may be provided from a tank or gas line. When the fuel source comes from a gas line, it may be stored within the furniture or external to the furniture piece and connected via hosing or other conduit. For example, the fuel may be provided from a tank such as a propane tank, which may be hidden within the furniture. A regulator and/or a valve may be used to control the amount of fuel accessible to the flame element.

The fire feature may also be provided through a burning tray and use combustible materials, such as wood or charcoal. In alternate embodiments, heat refractants may be added to the fire element for aesthetic purposes or functional purposes such as to spread heat. In at least one embodiment, refractants such as fire glass or lava rocks may be added to the heat element.

The entertainment table may also comprise a water feature in various embodiments. Preferably, the entertainment table comprises a water fountain feature that empties into a basin or container defined by and contained in the furniture piece. To power the fountain, a pump is operably installed to move water collected in the basin up through and out the fountain, thereby falling into and recollecting in the basin. The pump may be fluidly connected to the fountain element and the basin reservoir via conduits (i.e., hoses, piping, or other tubing), thereby allowing for the water to be recirculated by the pump. Various pumps may be used. In a preferred embodiment, the pump is a submersible bilge pump that is located within the basin reservoir such that the pump intake is below the water line of the basin. In at least one embodiment, the basin comprises a pluggable drain.

The pumps are preferably selected to operatively provide a flow commensurate with the size and amount of spigots or outlets for the waterfall. In a typical embodiment, the pump may selected that is rated to move between 0.5 to 50+ gallons per minute. The pump may also be operatively controllable to throttle the amount of water it moves from a trickle to a full stream. It may be desirable for the outlet or spigot to be shaped to cause the water to cascade out like a waterfall.

The fire feature is preferably centered in the entertainment table. In a further preferred embodiment, the fire feature is located on a platform that raises out of the center of the basin and the fountain cascades out from the platform and into the basin.

The entertainment table may also comprise a music feature comprising an amplifier, a receiver or other input, and one or more speakers. It is preferred that the music feature is capable of interfacing with external music sources either wirelessly or via a wired connection. A speaker may be mounted on the side wall of the furniture piece. In an embodiment, at least one speaker is mounted on the other side of a side wall in relation to the basin being the interior side. In another embodiment, at least one speaker is mounted in each of two opposing sides of the furniture piece to emit sounds in opposite directions of each other. In a square or rectangular embodiment of the table, as opposed to a table with a circular base, at least one speaker may be mounted in two opposing side walls, but preferably all four. It is preferred that the speakers and other electronic components be incorporated to minimize their exposure to the water in the basin. In some embodiments, the speakers are installed to minimize exposure to the water in the basin and from ambient weather such as rain. In one or more embodiments, marine rated speakers may be used. In such an embodiment, one or more speakers may be placed on the interior side of the side walls facing into the basin to use the natural amplification effect. And in other embodiments, the ridge or ledge formed from and extending outwards from the top of the side wall at least partially shields the speakers from ambient precipitation. In other embodiments, the speakers may be mounted on, in, or at least in substantially close proximity to the base to minimize their view. In embodiments wherein the speakers are mounted underneath the system, they are more shielded from the environment.

The music feature is preferably connectable to external music sources, either wirelessly or through wired connection. In one or more embodiments, the music feature is capable of connecting to external sources through Bluetooth technology.

Lighting features connected to a power source are also mounted throughout the furniture piece. Preferably, the lights are LEDs. The lights may be used as accent lights. Lights may also be placed in the basin to provide light to the water collected therein. In some embodiments, the lights are in communication with the music feature and react to the music such as by an onboard controller. In other embodiments, the lights used may have a built-in controller.

DETAILED DESCRIPTION OF THE INVENTION

To understand the novelty of the entertainment table, reference is hereafter made to the accompanying figures. With reference to FIGS. 1-4, a simplified illustration of the present entertainment table is provided. In general, the entertainment table 0 comprises a fire feature 10, a water feature 20, a music system 30, and light features 40 to provide an all-in-one entertainment center.

In general, the frame of the entertainment table 0 is defined by a plurality of side walls 1*a,b,c,d* bound and connected on the bottom by base plate 2 to define a basin 3 in which water can be collected. A ledge 4 bounds the top edge of side walls 1*a,b,c,d* opposite the base plate 2. Ledge 4 defines the opening into the basin 3. It is preferred that the ledge 4 extend outward, away from the basin a sufficient width and strength to hold drinks and, in some applications, plates, although larger widths may be desired in various embodiments. In various embodiments, the ledge may be on at least one side wall.

Additionally, a support column 5 extends upwards from the center of the base plate 2 and terminates in a platform 6 which sits above the basin. Support legs 7 attach to the bottom side of the base plate 2 to provide height to the entertainment table 0. The support legs 7 should be at least 2-12 inches to provide clearance from the ground, although embodiments are envisioned wherein the entertainment table 0 sits on the ground or wherein the support legs 7 are longer than 12 inches. In some embodiments, the legs may be adjustable. Foot rests 8 which is depicted as a rail can be mounted to the entertainment table 0 as well such as to either the support legs 7 or to the side walls 1*a,b,c,d*. In one or more embodiments, the top ledge 4 is between 12-48 inches off the ground (or other external surface). In alternate embodiments, it may sit between 12-28 inches off the ground for conversational setups, between 28-32 inches for dining set ups, between 32-38 inches off the ground for counter height, and between 38-48 inches off the ground for bar height.

As depicted, the side walls 1*a,b,c,d* comprise two sets of opposing walls that extend upwards from base plate 2 to define a square interior chamber in basin 3. In various embodiments, the side walls can define a basin with a cross section of various shapes such as a rectangle, circle, or triangle, or even less commons shapes such as stars or a fleur de lis, based on consumer preference. The side walls further comprise ports 9 which allow viewing of the interior chamber or for light to permeate through to ambient.

Figure 7:
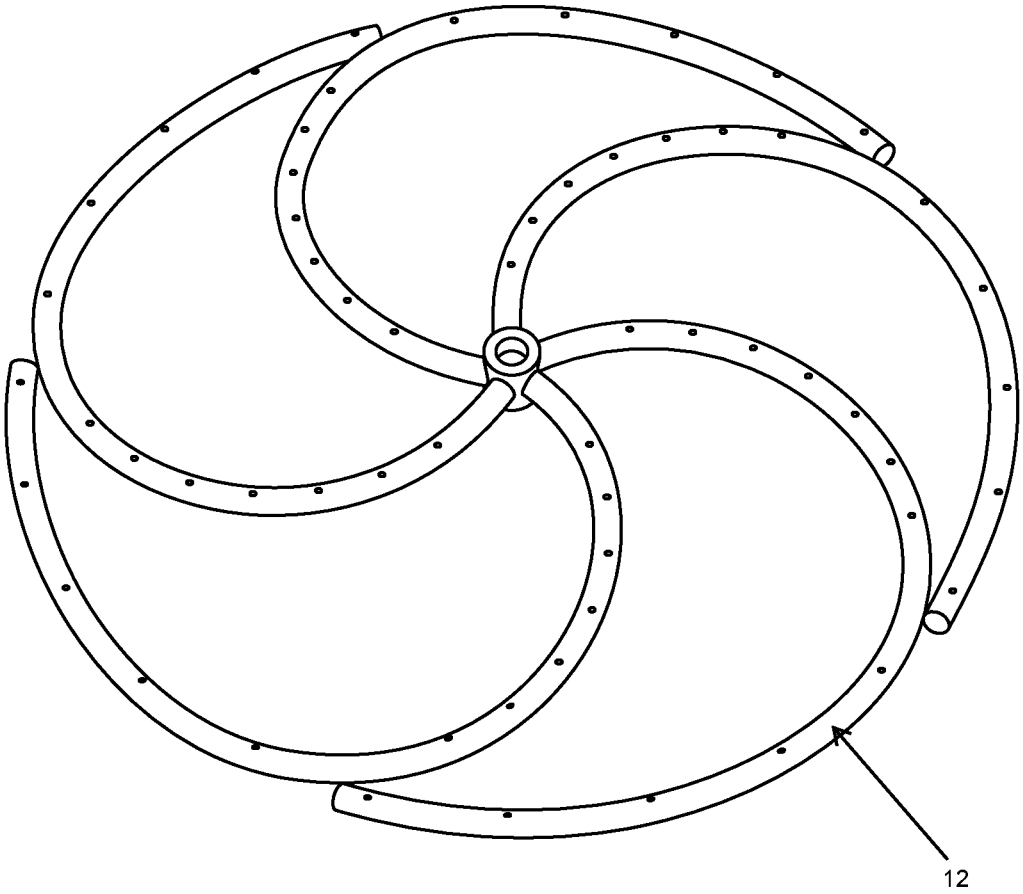
FIG. 7 is a zoomed in view of the burner.

The fire feature 10 is located on top of the center platform 6. It is preferred that the fire feature is located within or at least spatially above the confines of the basin to provide a barrier or separation between the fire and users nearby. The fire feature comprises a fire plate 11, a flame element 12, a heat dispersant 13, a gas hose conduit 14, a fuel source 15, and an igniter 16 operationally located to ignite the flame element. The representative burner is only depicted in FIG. 7 so as to not block other components. A raised fire plate 11 is placed on top platform 6. It is preferred, but not necessary, that the fire plate 11 be attached to the platform 6 to secure it. It may be preferable that the fire plate be removably attached in some embodiments to allow interchange and/or to access the column to clean or repair the fuel line. In other embodiments, the fire plate may be permanently attached such as through molding or welding. The flame element 12, which is depicted as a burner unit, is connected to the top of the fire plate 11. Numerous flame elements can provide the fire component. A representative example is the Firenado™ burner by Blaze Outdoor Products™ of Baton Rouge, La. The depicted burner is fueled by flammable gas provided from a fuel source 15 by gas hose conduit 14. The burner can be between 1,000 BTU and 200,000 BTU or greater. The depicted Firenado Burner is 147,000 BTU. The fire provides light and heat to the ambient area, but it should not necessarily drown out the light. Therefore, the burner should be sized to the appropriate size apparatus. To maximize aesthetics of the entertainment table 0, the gas hose conduit 14 runs through the support column 5 via a channel there through, and into the fire plate 11 where it is connected to the flame element 12. Glass beads are spread across the fire plate 11 to form the heat dispersant 13 and to localize the flame to the fire plate 11.

Figure 5:
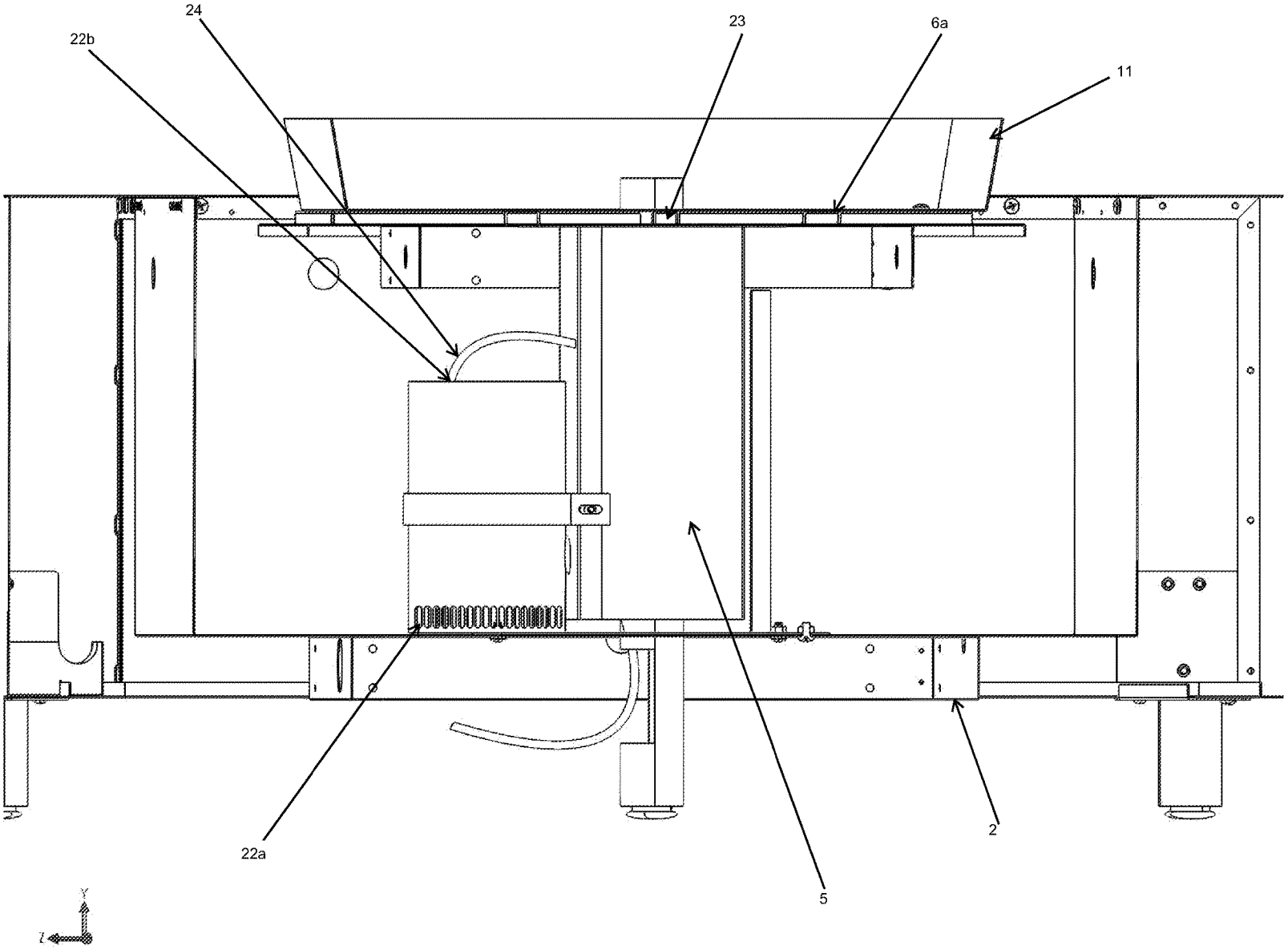
FIG. 5 is a cross sectional view of the entertainment table with the extenders removed to show the pump.

The water feature 20 comprises basin 3, a waterfall feature 21, a pump 22 further comprising an inlet 22*a* and an outlet 22*b*, a water spreader 23, and a water hose conduit 24 connecting the outlet 22*b* and the water spreader 23. A gap is formed between the raised fire plate 11 and the top of platform 6 by spacers 6*a,b,c,d*. The spacers act to provide a gap to allow water to flow and also as barriers that help direct the flow of water. As depicted in FIG. 5, the pump 22 is a submersible bilge pump that is placed inside the basin 3 such that the water intake 22*a* remains below the waterline. Numerous pumps and pumping configurations are possible. A commercially readily available pump suitable for this application is the SPXFLOW L4000 Submersible Bilge Pump by Johnson Pump which has max flow of 252 L/min or 4000 GPH. This is a 12V pump so it should be connected to a power source such as a 12V battery or AC/DC. It is preferable that the pump use a similar power source to the light system.

Water is pumped from the reservoir defined by basin 3 through the pump 22 wherein it flows into water hose conduit 24. Again, to maximize aesthetics, the water hose conduit 24 also runs through support column 5 and onto platform 6 wherein the water exits an outlet. As depicted, the outlet comprises, but does not necessarily need to comprise, a water spreader 23 that spreads the water outwards and across the platform 6 wherein it cascades off the edge of the platform 6 to form a waterfall feature 23. The water spreader may be in different shapes and may be slotted to divert water. It may be elongated in shape. The water falls into the basin 3 reservoir, thereby allowing it to be pumped again via recirculation. To further assist in aesthetics, the pump 22 may be housed in a permeable housing within the basin 3 created out of a similar or identical material to the interior wall, thereby hiding the pump 22 from view.

In alternate embodiments, the water may flow outward from the interior side of one or more side walls 1. In such an embodiment, the water outlet may be in the form of a jet or may continue to employ a water spreader, such as an elongated water spreader to provide the shape of wider waterfall.

The music feature 30 comprises an amplifier 31, a receiver 32, a plurality of speakers 33*a,b,c,d*, speaker wires 34, and an electrical power source. The amplifier 31 and receiver 32 are located in a substantially weatherproof housing either in the side wall 1*a* or, in alternate embodiments, may be located underneath the base plate 2. The receiver 32 is capable of receiving signals both wirelessly and via wire from external music sources. The receiver 32 is also capable of communicating these signals to the amplifier 31 so that it can, in turn, power the speakers 33. A commercially readily available amplifier is the Pyle Hydra Marine Amplifier, model: PLMRMB4CB Wireless Bluetooth. The speakers 33*a,b,c,d* are located in each side wall 1*a,b,c,d* to play omnidirectional music.

Figure 6:
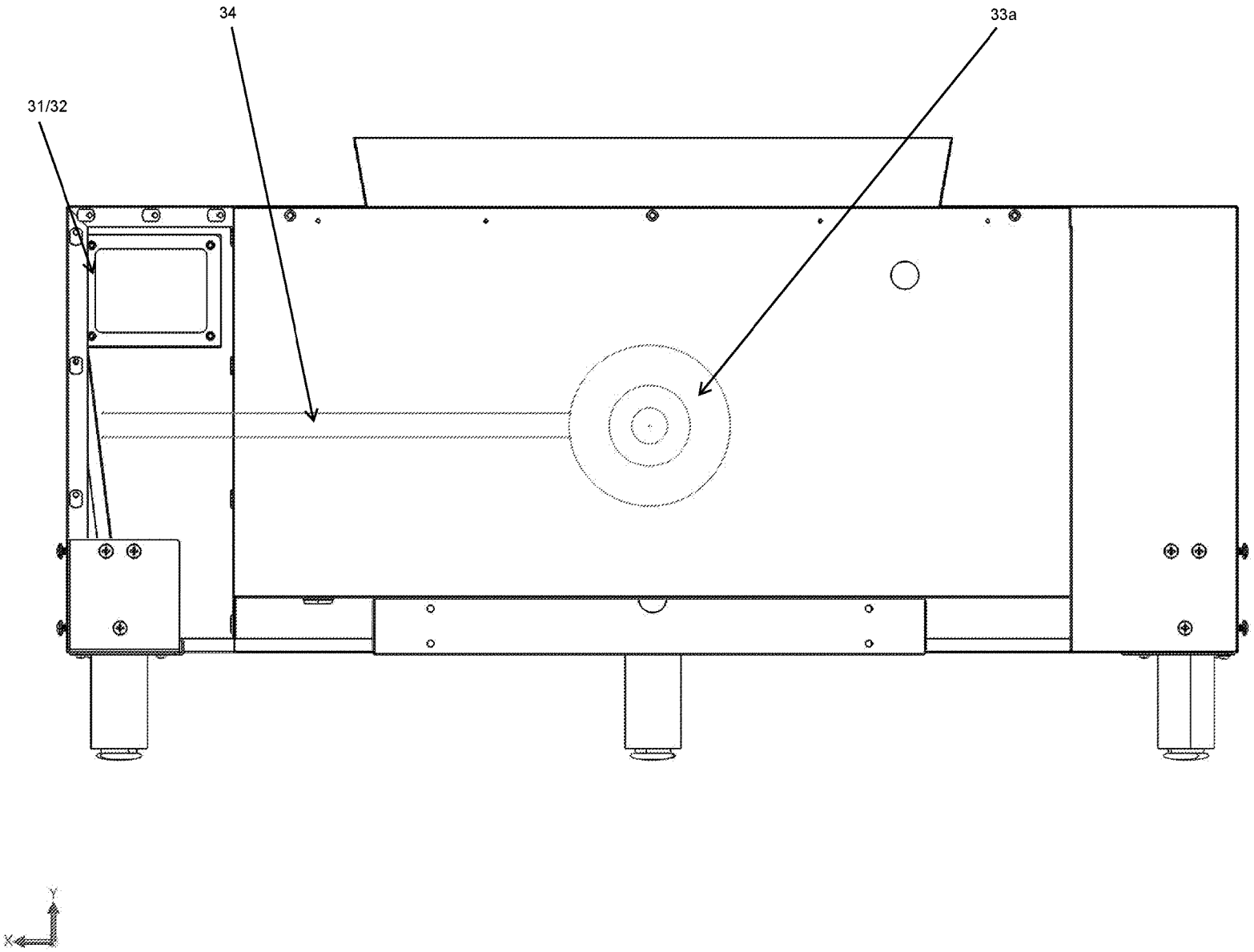
FIG. 6 is a side view of the same entertainment table of FIG. 5 with one panel of the side wall removed to show the speaker wiring.

As shown in FIG. 6, the speaker wires 34 are run through a conduit or gap that exists between the exterior and interior sides of the side walls 1*a-d*. It is preferred that the side walls have a gap between the sides as opposed to a conduit. In addition to allowing the speaker wires to be hidden, this air gap can, depending on its width, dissipate some of the heat omitted from the flame, thereby insulating the outer layer and preventing burns. This gap may be between 0.1 to 2 inches.

The lighting system 40 comprises a control unit 41, a series of LED light strips 42, and a remote 43. The LED Light strips 42 are positioned about the entertainment table 0 to provide accent lights which are color changeable and dimmable. The controller is programmable. It can also be programmed to change lights based on the music played by the music feature 30. It is preferred, but not required, that a common controller control both the lights and the music feature.

Numerous components of the system may require electricity to operate. For example, the pump, the speakers, and the lights will require a power source which is not depicted. This may come in numerous forms and may either be a consolidated power source or it may be a discrete source for one or more of the individual components. In one or more embodiments, the power supply will come through an electrical conduit. In others, it may come from a battery, or a combination of a battery and a hard wired line. In others, a/c or d/c currents may provide the necessary electricity.

When not in use, a cover 50 can be placed over the flame feature 10 and basin opening. Additionally, slats may be cut in the cover such that the cover may be placed on the apparatus even when operating.

In alternate embodiments, it may be advantageous to have the ledge at bar height. This can be accomplished by using longer leg members; however, consideration must be given to center of weight and balance of the unit. Therefore, as depicted in FIG. 1, another option is to have longer side walls 1*a-d* such that the top end terminates at bar height. To allow for additional water sound to permeate to ambient as well as light from within the basin (either caused by fire or actual lights), slats or ports 9 may be cut into the side walls. Moreover, to prevent water from splashing out, flashings 9*a* extend inward and downward from the side wall towards the center base of the basin. The flashings may also direct heat out of the system to ambient.

For the purpose of understanding the entertainment apparatus, references are made in the text to exemplary embodiments of an entertainment apparatus, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the entertainment apparatus may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

Moreover, the terms "substantially" or "approximately" as used herein may be applied to modify any quantitative representation that could permissibly vary without resulting in a change to the basic function to which it is related.

The invention claimed is:

1. An entertainment apparatus comprising: a. A piece of furniture comprising at least three of the following: a fire feature, a water feature, a light system and a music system; b. Wherein the furniture comprises a base and at least one side wall, said side wall comprising a top end and a bottom end, wherein the side wall is connected to the base on the bottom end and extends upwards from the base to the top end, thereby defining a container with an opening opposite the base, wherein said container is substantially sealed to hold at least some water; c. Wherein the fire feature comprises at least one burner operatively connected to a fuel source and an igniter operationally located to be able to ignite the burner; d. Wherein the water feature comprises a pump with an input and an output, a water conduit, and at least one outlet, wherein said pump input is in fluid communication with the contents on the inside of the container and said outlet is in fluid communication with the pump output via said water conduit, and wherein said at least one outlet is positioned to emit water moved through it by said pump back into the container; e. Wherein the light system comprises at least one light; f. Wherein the music system comprises at least one speaker capable of playing music; and further comprising a support structure with two ends that extends upwards from a first end from a position at or near the center of the base within the container to the second end, wherein a platform is attached to the support structure on the second end, wherein the burner is located on top of the platform, and wherein the burner is operatively connected to the fuel source via a conduit that is run at least partially through the support structure.

2. The entertainment apparatus of claim 1 wherein the water outlet is located between the platform and the burner and wherein the water conduit runs at least partially through the support structure.

3. The entertainment apparatus of claim 2 wherein a fire tray separates the at least one water outlet and the burner.

4. The entertainment apparatus of claim 3 wherein the at least one water outlet comprises at least two barriers to direct the flow outwards from the center of the platform in opposing directions.

5. The entertainment apparatus of claim 4 wherein at least four water barriers radially extend outwards from the center of the platform.

6. The entertainment apparatus of claim 1 further comprising at least one controller wherein the at least one controller is capable of controlling the music system, the light system, or both.

7. The entertainment apparatus of claim 1 wherein legs extend downwards from the base towards the ground to raise the base off the ground.

8. The entertainment apparatus of claim 1 wherein the furniture comprises a plurality of contiguous side walls that form the perimeter of the container.

9. The entertainment apparatus of claim 8 wherein the furniture comprises two sets of opposing side walls, each with an interior side defining the container and an exterior side facing away from the container, wherein at least one speaker is mounted to the exterior side of each of at least one set of opposing side walls.

10. The entertainment apparatus of claim 9 wherein the side walls further comprise an air gap between the interior side and the exterior side, wherein at least part of the speaker wires and run through the air gap.

11. The entertainment apparatus of claim 9 wherein the furniture further comprises a ledge extending from the top end of the side wall outwards away from container and wherein the ledge is located between 30-54 inches from the ground.

12. The entertainment apparatus of claim 9 wherein an extender piece is added to the side walls extending on one end upwards from the side walls to a second end and wherein a ledge extends outwards from the second end away from the container.

13. The entertainment apparatus of claim 9 wherein the light system comprises at least one LED strip, wherein the at least one LED strip is mounted to the furniture in at least one location selected from the group comprising the bottom side of the base, the bottom side of the ledge, the speaker mount, or inside the container.

14. The entertainment apparatus of claim 13 further comprising a controller that is operationally configured to synch the hue of the lights with music played by the music feature.

15. The apparatus of claim 9 wherein:

a. The music feature further comprises at least 4 speakers, at least one in each of the four side walls, wherein the speakers are mounted to face outwards away from the container and the speakers are connected to a receiver through the wires which are run at least partially through the side wall in which the respective speaker is mounted;

b. the light system comprises at least one LED strip, wherein the at least one LED strip is mounted to the furniture in at least one location selected from the group comprising the bottom side of the base, the bottom side of the ledge, the speaker mount, or inside the container;

c. a support structure with two ends extends upwards from a first end from a position at or near the center of the base within the container to an opposing second end, wherein a platform is attached to the support structure on the second end, wherein the burner is located on the opposite side of the platform as the support structure, and wherein the burner is operatively connected to the fuel source via a conduit that is run at least partially through the support structure and the platform;

d. the water outlet is located between the platform and the burner and wherein the water conduit runs at least partially through the support structure; and e. a ledge extends outwards from the top side of the side wall.

16. The entertainment apparatus of claim 1 wherein at least one speaker is mounted to the side wall facing way from the container.

17. The apparatus of claim 1 wherein the furniture further comprises a ledge extending from the top end of the side wall outwards away from container.

18. The entertainment apparatus of claim 1 wherein at least one speaker is mounted to the base.

* * * * *